US005921414A

United States Patent [19]

Burke et al.

[11] Patent Number: 5,921,414

[45] Date of Patent: Jul. 13, 1999

[54] DOUBLE SIDED DISPLAY RACK

[75] Inventors: Wade P. Burke, Watauga; Ray M. Lewis, II, Fort Worth, both of Tex.

[73] Assignee: Marco Display Specialists, Inc., Fort Worth, Tex.

[21] Appl. No.: 08/856,770

[22] Filed: May 15, 1997

[51] Int. Cl.[6] ..... A47B 43/00

[52] U.S. Cl. ..... 211/187

[58] Field of Search ..... 211/187, 186, 211/150, 151, 175; 248/235

[56] References Cited

U.S. PATENT DOCUMENTS

| | | | |
|---|---|---|---|
| 4,776,472 | 10/1988 | Rosen | 211/187 |
| 4,790,707 | 12/1988 | Magretta et al. | 211/187 |
| 5,439,122 | 8/1995 | Ramsay | 211/187 |

OTHER PUBLICATIONS

Brochure of Item No. BAK–400, The Marco Company.
Brochure of Item No. BAK–402, The Marco Company.
Brochure of Item No. Cart–03, The Marco Company.
Brochure of Cart–02 With Liner and Riser, The Marco Company.
Brochure of Cart–04, The Marco Company.

*Primary Examiner*—Alvin Chin-Shue
*Assistant Examiner*—Sarah Purol
*Attorney, Agent, or Firm*—Geoffrey A. Mantooth

[57] ABSTRACT

The display rack includes a frame, an extension, and first and second sets of shelves. The frame has a base and posts that extend from the frame. The posts have a first side and second side. An extension is slidably coupled to the base. The first set of shelves is located on the first side of the posts, while the second set of shelves is located on the second side of the posts. The extension moves between extended and stowed positions. In the extended position, the extension is extended from the base on a second side of the posts. A bottom most shelf of the second set of shelves is coupled to the posts and bears on the extension. The second set of shelves can be hung on the second side of the posts when the extension is extended. The rack is double sided in this configuration. The rack can be converted to a single sided rack by stowing the extension into the base. The shelves can be allowed to depend from the posts, or removed from the posts all together.

8 Claims, 4 Drawing Sheets

DOUBLE SIDED DISPLAY RACK

FIELD OF THE INVENTION

The present invention relates to apparatuses used to display goods, such as food items.

BACKGROUND OF THE INVENTION

Merchandising is the promotion of the sale of an item or product by displaying or advertising the item. For example, grocery stores practice merchandising extensively. This is especially true with baked goods, produce, and meats. The items are displayed for sale on racks or stands or in bins. The objective of merchandising is to attractively display the product to a purchasing customer.

The size of the display is important. Ideally, the display should be large enough to display the desired quantity of products. Empty shelves are not attractive and are avoided by many stores.

As an example of merchandising, many grocery stores have an in store bakery. The baked goods are typically displayed for sale on a rack.

A problem arises with the volume of baked goods that are displayed. Certain days of the week may be slower, from a sales point of view, than are other days of the week. For example, in some stores, customers buy fewer baked goods on Mondays and Tuesdays than on other days of the week.

A conventional rack is undesirable to display such baked goods because of the change in volume of the goods that are to be displayed. A conventional rack may have plural shelves that are stair stepped. If a large rack is used, the rack is satisfactory for Wednesdays through Sundays, when large volumes of baked goods are displayed for sale. However, on Mondays and Tuesdays, such a rack is too large, and presents empty shelves to customers. If a smaller rack is used, the rack is satisfactory for days with low sales volume, but is too small for heavy volume sales days. Such racks on busy days must be frequently restocked, adding to labor costs.

SUMMARY OF THE INVENTION

It is an object of the present invention to provide a rack that can be adjusted to display various amounts of merchandise.

It is an object of the present invention to provide a rack that can be adjusted to display various amounts of merchandise in an easy and aesthetic manner.

The present invention provides a display rack comprising a frame, an extension, a first set of shelves, and a second set of shelves. The frame has a base and posts that extend therefrom. The posts are separated from each other by a distance. The posts have first and second sides. The extension is slidably coupled to the base. The extension moves between an extended position and a stowed position. The extension extends out from the base on the second side of the posts when the extension is in the extended position. The extension is contained within the base when the extension is in the stowed position. The first set of shelves is coupled to the posts and is located on the first side of the posts. The second set of shelves is located on the second side of the posts . The second set of shelves is coupled to the posts. The second set of shelves comprises a bottom shelf that is coupled to the posts and that bears on the extension when the extension is in the extended position.

In accordance with one aspect of the present invention, the bottom shelf is pivotally coupled to the posts, wherein when the extension is in the stowed position, the bottom shelf depends from the posts.

In accordance with another aspect of the present invention, the second set of shelves comprise an upper shelf. The upper shelf is removably coupled to the posts by shelf hangers. Each shelf hanger has at least one insert for coupling to the posts, wherein when the insert is coupled to the posts, the upper shelf extends out from the posts. Each of the shelf hangers also has a hook for coupling to the posts. When the hook is coupled to the posts, the upper shelf depends from the posts.

In accordance with still another aspect of the present invention, the extension is slidably coupled to the base by way of drawer guides.

In accordance with still another aspect of the present invention, the base has first legs and the extension has second legs. The legs can comprise casters.

The display rack of the present invention can convert between a double sided rack or a single sided rack. In its double sided configuration, shelves are provided on first and second sides of the rack. The shelves extend out in a generally horizontally orientation, wherein products can be placed on these shelves for display and sale.

The size of the shelf can be decreased by converting the double sided rack to a single sided rack. The shelves on one side of the rack are removed or allowed to hang vertically. The rack can then be placed against a wall.

The rack is provided with an extension that moves in and out of a base. When the rack is in its double sided configuration, the extension is extended out from the frame or base. The extension has legs thereon, to provide stability and support to the shelves on that side of the rack.

DESCRIPTION OF THE PREFERRED EMBODIMENT

Figure 1:
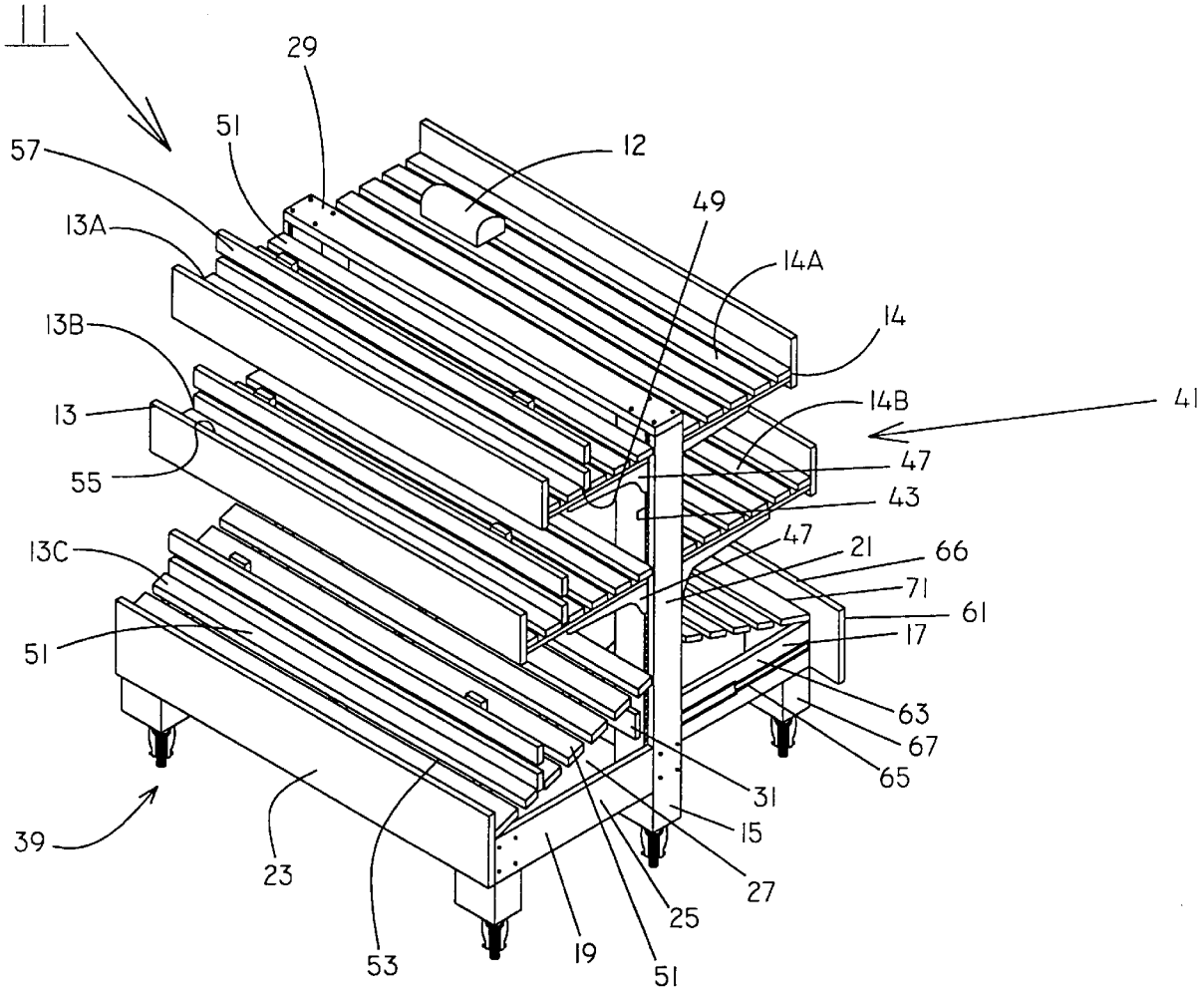
FIG. 1 is an isometric view of the display rack of the present invention, in accordance with a preferred embodiment, showing the front side of the rack.

Referring to FIG. 1, the rack 11 of the present invention can be used to display products 12 for sale. The rack has plural shelves 13 on a front side and plural shelves 14 on a rear side. Products 12, such as baked goods, can be displayed on any one of the several shelves 13, 14 of the rack 11.

Figure 2:
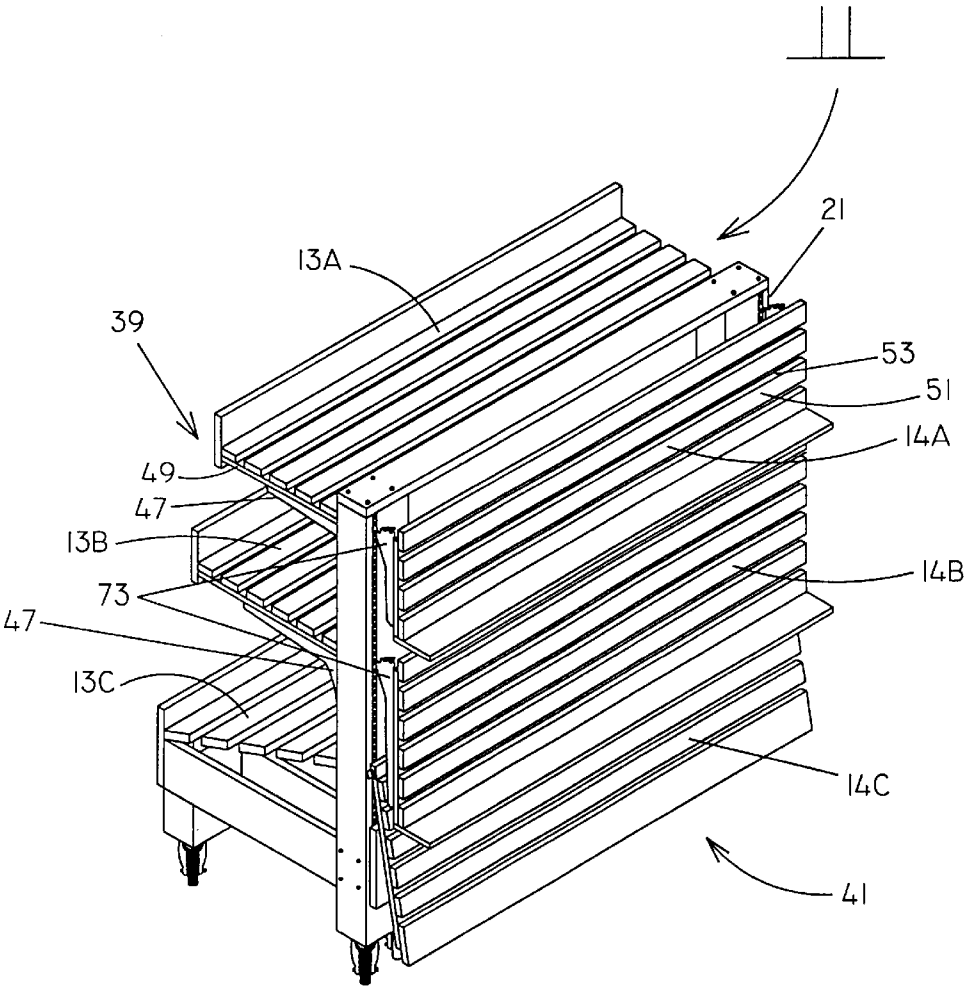
FIG. 2 is an isometric view of the display rack of FIG. 1, showing the rear side of the rack, with the rear side shelves folded down.

The size of the rack 11 can be adjusted so as to expose for display a large amount of shelf space. FIG. 1 shows the rack 11 configured to display a large amount of shelf space. There are shelves on both sides of the rack. If the amount of shelf space is needed to be reduced, then the shelves 14 on the rear side 41 can be swung down, or removed, leaving the shelves 13 on the front side 39 to display products. FIG. 2 shows the rack in this reduced shelf space configuration. The rack of FIG. 2 takes up less room in a store and can be placed with its rear side against a structure such as a wall or another rack.

The rack 11 will now be described in more detail with reference to FIG. 1. The rack has a frame 15, plural shelves 13 on one side of the frame, and plural shelves 14 on another side of the frame. The rack 11 also has an extension 17. In the description that follows, terms such as "top", "bottom", "front", and "rear", refer to the orientation of the rack as shown in FIG. 1.

Referring to FIG. 2, the frame 15 includes a base 19 and posts 21. The base 19 is generally rectangular when viewed in a plan view. The base 19 has a front beam 23 or member, which is coupled to the posts 21 by transverse beams 25. In the preferred embodiment, each end of the front beam 23 has two transverse beams 25 coupled thereto and separated from each other by a gap 27. In the rear of the gap are the posts 21. The posts 21 extend vertically upward through the gap to a distance above the base 19. The top ends of the posts are coupled together by a beam 29. Another beam 31 (see FIG. 1) is coupled between the posts at a location near the base. The bottom ends of the posts serve as legs 33 to support the rack on the floor. There are also legs 35 in the front of the gaps 27 at the front beam 23. Thus, there is a leg at each corner of the frame. At the bottom of each leg is a caster or wheel 37. The casters 37 are conventional and commercially available and are equipped with releasable locks or brakes to selectively prevent rotation thereof.

Figure 4:
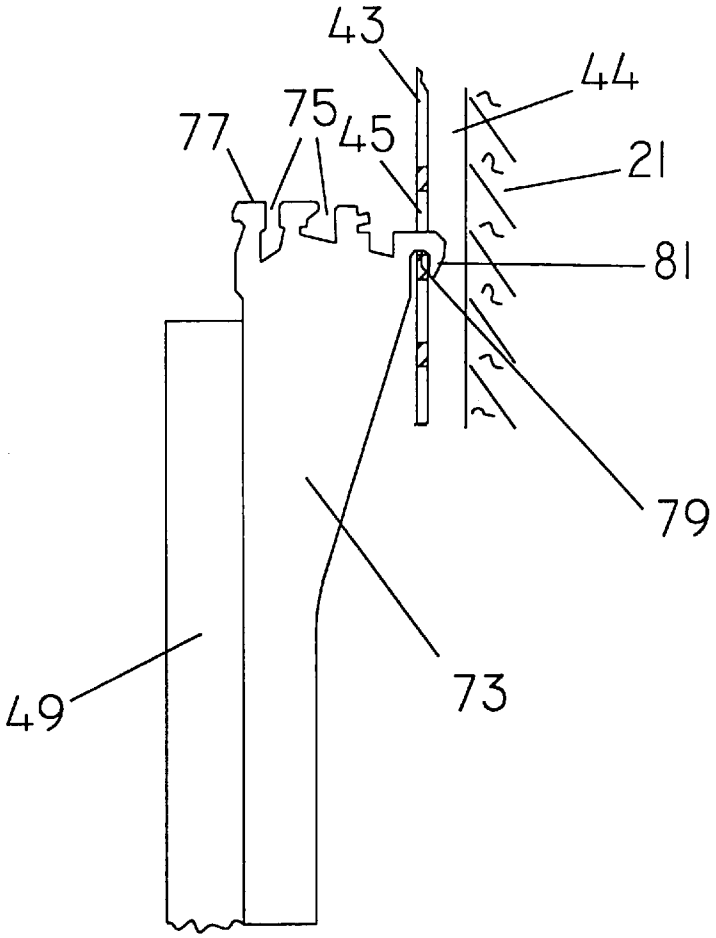
FIG. 4 is a closeup side view of a shelf hanger of the present invention, shown as hung on a standard in the stowed position.

The posts 21, and thus the rack 11, have a front side 39 and a rear side 41 (see FIGS. 1 and 2). Each of the front and rear sides 39, 41 of each post 21 has a shelving standard 43. The standards 43, which are conventional and commercially available, have openings 45 (see FIG. 4) therein for receiving conventional and commercially available shelf hangers or supports 47. The posts each have a groove 44 for receiving hooks.

In the preferred embodiment, there are three front side shelves 13A, 13B, 13C (see FIG. 1). Each shelf is made of transverse members 49, which extend from the front side 39 towards the rear side 41 of the rack. In the preferred embodiment, there is a transverse member 49 at each end of the shelf and a transverse member in the center of the shelf. Overlying the transverse members are slats 51, extending along a length of the shelf. The slats 51 are separated from each other by gaps 53 for aesthetic appeal. The top and intermediate front shelves 13A, 13B are hung on the posts 21 by way of shelf hangers 47. The hangers 47 are mounted to the underneath side of the endmost transverse members. The shelf hangers 40 are received by the notches in the standards 43 on the front side 39 of each post 21. The standards allow the shelves 13A, 13B to be oriented horizontally. The shelves can be oriented truly horizontally, or inclined downwardly somewhat (wherein the rear side of the shelf is higher than the front side). The hangers 47 and the standards 43 allow the height of the top and intermediate shelves 13A, 13B to be adjusted.

In the preferred embodiment, the top shelf 13A is shorter in width than the intermediate shelf 13B. Thus, the top shelf 13A does not extend as far out from the posts 21 as does the intermediate shelf 13B.

The bottom shelf 13C is mounted at a downwardly inclined angle. The rear corners of the shelf 13C are mounted to the posts 21, while the front edge is mounted to the front beam 23 of the frame. The shelf 13C need not be made adjustable in height along the posts 21 and is mounted to the posts and frame with screws or other fasteners. The shelf 13C could be made adjustable however.

The bottom shelf 13C is preferably inclined downwardly such that its rear side is higher than its front side. If so desired, the bottom most shelf can be horizontal. The upper two shelves 13A, 13B can be either horizontal or inclined downwardly.

The front side of each shelf can be equipped with an upstanding lip 55 to prevent products from sliding off of the shelf. Product stops 57 can be inserted into each shelf. A product stop 57 is a short wall that is inserted into a gap 53 between two adjacent slats 51 in a shelf. The stops prevent products from sliding off of the shelf.

In the preferred embodiment, there are also provided three rear side shelves 14A, 14B, 14C. The rear side shelves are substantially similar to the front side shelves, with differences that will be described hereinafter.

To maintain consistency, the terms "front", and "rear" will continue to be used with respect to the orientation shown in FIG. 1. Note that FIGS. 2 and 3 show the rear side of the rack 11.

The bottom rear side shelf 14C is supported by an extension 17 of the base 19. The extension 17 is generally rectangular (when viewed in a plan view). The extension 17 has side beams 61 that extend for most of the length between the posts 21. The ends of the side beams 61 are coupled together by end beams 63. The distance between the end beams 63 is less than the distance between the inner most transverse beams 25 of the base. This allows the extension to be slidably coupled to the innermost transverse beams of the base. The extension 17 is coupled to the base 19 by way of drawer guides 65. The drawer guides 65 are mounted to the outer sides of the end beams 63 and to the inner sides of the innermost transverse beams 25 of the base 19. The rear side beam 61R is taller than the end beams so as to provide an upstanding lip 66.

Figure 3:
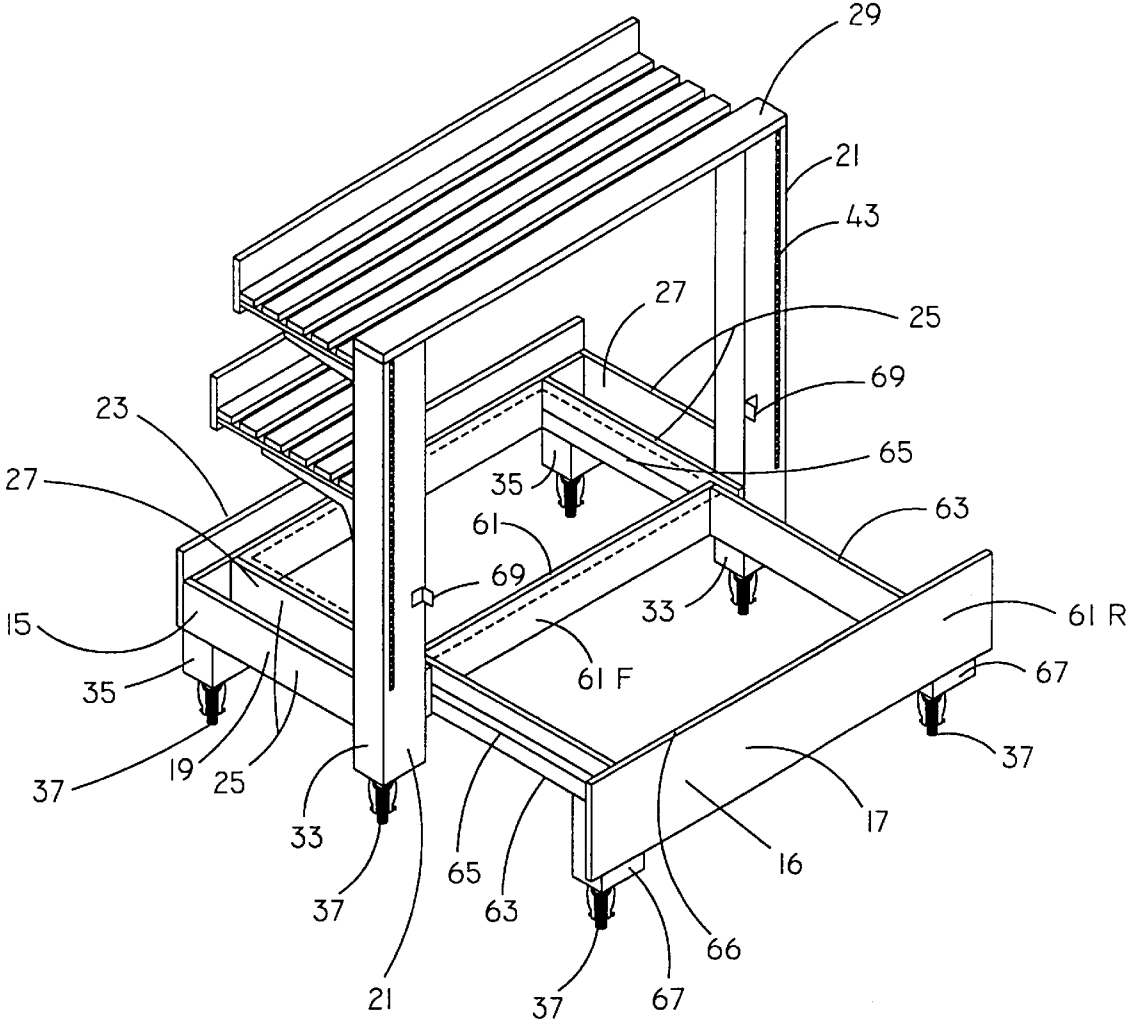
FIG. 3 is an isometric view of the frame, shown with the majority of the shelves removed.

The rear comers (the corners furthest from the posts as shown in FIG. 3) of the extension 17 have legs 67. The legs 67 have casters 37 thereon.

The extension 17 can be moved between an extended position (shown by solid lines in FIG. 3) and a stowed position (shown by dashed lines in FIG. 3). In the extended position, the extension 17 extends out from the rear side of the base. The front side beam 61F of the extension is located between the posts 21. Stops can be provided on the drawer guides or on the extension to prevent the extension from becoming pulled out all the way from the base so as to disengage the drawer guides. In the stowed position, the extension 17 is contained inside of the base 19.

The rear bottom shelf 14C is pivotally coupled to the posts 21. The rear corners of the rear bottom shelf are mounted to the posts. For example, a mounting member 69 (see FIG. 3) can be used. When the extension is pulled out from the base to its extended position, the rear edge 71 (see FIG. 1) of the bottom shelf 14C bears on the end beams 63 and against the beam 61. When the extension 17 is in its stowed position, the bottom shelf 14C hangs down along the rear side 41 of the rack 11 toward the floor (see FIG. 2).

The rear top and intermediate shelves 14A, 14B are equipped with shelf hangers 73 that are modified from the shelf hangers 47 of the front shelves 13A, 13B. The shelf hangers 73 have conventional notches 75 and inserts 77 for hanging the shelf either horizontally or downwardly on the standards 43 (see FIG. 4). However, the bottom of each shelf hanger 73 has a notch 79 formed therein, which notch is in the opposite direction of the conventional notches 75. The notch 79 forms a hook 81, which hook is received in the standard 43. Hanging a shelf 14A, 14B by these hooks 81 (one hook on each hanger 73) allows the shelf to depend down towards the floor in a vertical or near vertical orientation, as shown in FIG. 2.

The operation of the rack will now be discussed. As shown in FIG. 1, the rack 11 is double sided. There are shelves on the both the front side 39 and the rear side 41 of the rack. Products 12, such as baked goods can be placed on the shelves.

The rack can be made one sided, or smaller, by stowing the rear shelves 14. The rear bottom shelf 14C is stowed first. The rear edge 71 of the shelf 14C is raised slightly so as to clear the lip 66 on the extension 17. The extension 17 is then pushed into the base 19 to the stowed position.

Once the extension is stowed inside of the base (see dashed lines of FIG. 3), the bottom shelf 14C is allowed to swing down towards the floor (see FIG. 2). The bottom shelf 14C takes on a vertical (or near vertical orientation), hanging from the rear side 41 of the posts 21.

Next, the other two shelves 14A, 14B are changed from a generally horizontal orientation as shown in FIG. 1 to a vertical orientation as shown in FIG. 2. Working from the bottom up, the intermediate shelf 14B is removed from the posts 21. Specifically, the inserts 77 (see FIG. 4) of the shelf hanger 73 are freed from the standards 43. Then, the hangers 73 are reengaged to the standards 43 by way of the hooks 81. The shelf 14B now hangs in a vertical (or near vertical) orientation along the rear side of the rack. The top shelf 14A is hung in the same manner.

As an alternative to storing the shelves by hanging the shelves vertically from the rack, the shelves can be removed completely from the rack and stored in a separate location.

Once the shelves are hanging vertically (or are otherwise stored), the rack becomes one sided. The rear side of the rack can be placed against a wall or some other structure (such as the end of a display case). Products are placed on the front side shelves.

To convert the rack from one sided to a double sided rack, the rear side shelves are hung in a horizontal (or near horizontal) orientation, as discussed above.

The rack 11 can be made of wood or metal. The drawer guides are preferably made of metal.

The foregoing disclosure and the showings made in the drawings are merely illustrative of the principles of this invention and are not to be interpreted in a limiting sense.

We claim:

1. A display rack, comprising:

a) a frame having a base and posts extending therefrom, the posts being separated from each other by a distance, the posts having a first side and a second side, the base being located on the first side of the posts;

b) an extension slidably coupled to the base, the extension moving between an extended position and a stowed position, the extension extended out from the base on the second side of the posts when the extension is in the extended position, the extension being nested with the base when the extension is in the stowed position;

c) a first set of shelves coupled to the posts and located on the first side of the posts;

d) a second set of shelves located on the second side of the posts, the second set of shelves being coupled to the posts, the second set of shelves capable of being located in either an extended position, wherein the second set of shelves extend out from the posts, or in a nonextended position, the second set of shelves comprising a bottom shelf that is coupled to the posts and that bears on the extension when the extension is in the extended position.

2. The display rack of claim 1, wherein the bottom shelf is pivotally coupled to the posts, wherein when the extension is in the stowed position, the bottom shelf depends from the posts.

3. The display rack of claim 1 wherein the second set of shelves comprise an upper shelf, the upper shelf being removably coupled to the posts by shelf hangers, each of the shelf hangers having at least one insert for coupling to the posts, wherein when the insert is coupled to the posts, the upper shelf extends out from the posts, each of the shelf hangers also having a hook for coupling to the posts, wherein when the hook is coupled to the posts, the upper shelf depends from the posts.

4. The display rack of claim 1 wherein the extension is slidably coupled to the base by way of drawer guides.

5. The display rack of claim 1 further comprising first legs on the base and second legs on the extension.

6. The display rack of claim 5 wherein the legs comprise casters.

7. The display rack of claim 1, wherein:

a) the bottom shelf is pivotally coupled to the posts, wherein when the extension is in the stowed position, the bottom shelf depends from the posts;

b) the second set of shelves comprise an upper shelf, the upper shelf being removably coupled to the posts by shelf hangers, each of the shelf hangers having at least one insert for coupling to the posts, wherein when the insert is coupled to the posts, the upper shelf extends out from the posts, each of the shelf hangers also having a hook for coupling to the posts, wherein when the hook is coupled to the posts, the upper shelf depends from the posts;

c) the extension is slidably coupled to the base by way of drawer guides;

d) the display rack further comprises first legs on a base and second legs on the extension, wherein the legs comprise casters.

8. The display rack of claim 1, wherein the bottom shelf of the second set of shelves is inclined when bearing on the extension.

* * * * *